United States Patent [19]

McClurg

[11] 4,029,022

[45] June 14, 1977

[54] CENTER BRACE CASTING

[75] Inventor: Carl D. McClurg, Lockbourne, Ohio

[73] Assignee: Buckeye International, Inc., Columbus, Ohio

[22] Filed: July 7, 1975

[21] Appl. No.: 593,197

[52] U.S. Cl. ..... 105/420
[51] Int. Cl.[2] ..... B61D 17/00
[58] Field of Search ..... 105/226, 228, 230, 415, 105/416, 417, 420; 213/57, 8

[56] References Cited

UNITED STATES PATENTS

| | | | |
|---|---|---|---|
| 1,736,292 | 11/1929 | Sleeman | 105/416 |
| 2,020,391 | 11/1935 | Wine | 105/415 X |
| 2,222,480 | 11/1940 | Cottrell | 105/420 X |

*Primary Examiner*—L. J. Paperner
*Assistant Examiner*—Randolph A. Reese
*Attorney, Agent, or Firm*—Charles F. Pigott, Jr.

[57] ABSTRACT

A center brace is provided for interchangeable use with hopper, box and gondola railway cars. The brace includes two hollow kingpin holes which permit such interchangeable use. Furthermore, the brace is also symmetrical about a horizontal plane so that the brace can be installed with either side up.

3 Claims, 7 Drawing Figures

CENTER BRACE CASTING

BACKGROUND OF THE INVENTION

This invention relates to an improved center brace for a railroad car, and more particularly, to a center brace that can be interchangeably used in a box, gondola or hopper car.

A center brace or bolster center filler is a box-shaped member positioned between the center sill and body bolster plates and has a single hollow kingpin hole for receiving a kingpin or bolt extending from a railway truck. Heretofore, the center braces required for use in standard box and gondola cars were different than the braces used in hopper cars. This was due to the fact that the distance between the rear draft lugs and the kingpin hole for a brace used in a standard hopper car was 17⅛ inches while the standard distance required for use in standard box and gondola cars was 23⅛ inches. This difference necessitated two separate braces — one for hopper cars and one for box and gondola cars — with the attendant higher manufacturing costs.

It is therefore one object of this invention to provide a single center brace which is adapted for use with box, gondola, and hopper cars.

It has also been found that center braces have occasionally been inadvertently installed wrong-side up. Such installation can only be corrected by removal and reinstallation of the brace which is both time-consuming and expensive.

Another object of this invention is to provide a center brace which can avoid the problem of wrong-side up installation.

A further object of this invention is to provide an improved center brace casting of relatively simple design and construction which achieves economy of manufacture and dependability in operation.

The foregoing and other objects and advantages will be apparent from the following description and appended claims, taken in conjuction with the accompanying drawings.

SUMMARY OF THE INVENTION

There is provided by virtue of this invention a center brace which can be interchangeably used in box, gondola and hopper railway cars. The center brace includes two substantially parallel and longitudinally spaced hollow kingpin holes, one of which is adapted to receive a kingpin associated with a hopper car, and the other of which is adapted to receive a kingpin associated with a box or gondola car.

Furthermore the brace is symmetrical about ahorizontal plane, and the top and bottom surfaces of the brace are substantially identical so that either surface may be positioned upwardly within the sill, thereby eliminating wrong-side-up installation.

A more detailed explanation of the invention is provided in the following description and appended claims taken in conjunction with the accompanying drawings.

DESCRIPTION OF THE ILLUSTRATIVE EMBODIMENT

Figure 1:
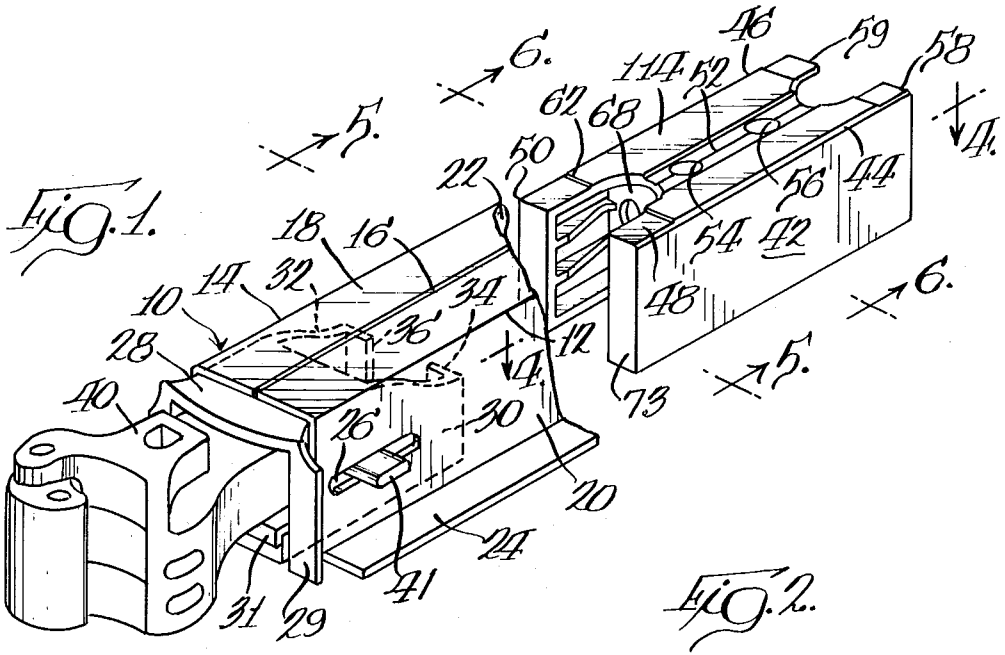
FIG. 1 is a perspective view of a center brace made in accordance with the principles of the present invention and out outboard portion of a center sill and coupler assembly.

Referring now to the drawings, there is shown a conventional double Zee-type center sill 10 which is formed from a pair of rolled-steel Zee sections 12 and 14 which have been welded together at the joint 16. The sill is a channel-shaped member including a top web 18 and a pair of side walls 20 and 22, each of which are connected along an edge to the top web. Each of the side walls terminates, along the opposite edge, in a lower outwardly extending flange, such as 24. At the outboard end of the sill 10, a pair of aligned draft key slots, such as 26, are provided, one in each of the side walls 20 and 22.

A striker assembly 28 is fitted and welded to the sill at its outboard end and includes (1) a striker face 29, which extends forwardly of the outboard end of the sill and (2) a pair of integral front draft lugs 30 and 32 positioned within the sill, which terminate in inner faces 34 and 36, respectively. Draft key apertures, such as 38, are provided in the side walls of the striker assembly intermediate the striker face 29 and inner faces 34 and 36. The draft key apertures are in alignment with the key slots, such as 26, in the sill 10. A coupler wear plate 31 is mounted to the striker 28 at its outboard end below the upper edge of the striker face.

A coupler assembly 40 and its associated yoke (not shown) are mounted to the outboard end of the sill and are secured to the sill by a draft key 41 which extends through the sill key slots 26, the striker apertures 38, and cooperating apertures in the coupler and yoke.

The center brace 42 is an assembly which is fabricated from a pair of identical mirror image castings or side members 44 and 46 that are welded together along the edges of a vertical interface. The brace 42 includes a pair of rear draft lugs 48 and 50, a center section 52 having two kingpin holes 54 and 56 therein and a pair of inner extensions 58 and 59. Each of the kingpin holes 54 and 56 are of a size and shape to receive a kingpin extending from a truck associated with a railway car and are formed by a respective king post extending between the top and bottom horizontal walls of the brace. The brace 42 is fitted within and welded to an inboard portion of the sill with the rear draft lugs 48 and 50 facing toward the coupler 40. Each side member, such as 44, provides one of the two rear draft lugs 48 or 50, defines a portion **52*a* of the center section 52 and provides one of the two inner extensions 58 or 59.**

Figure 4:
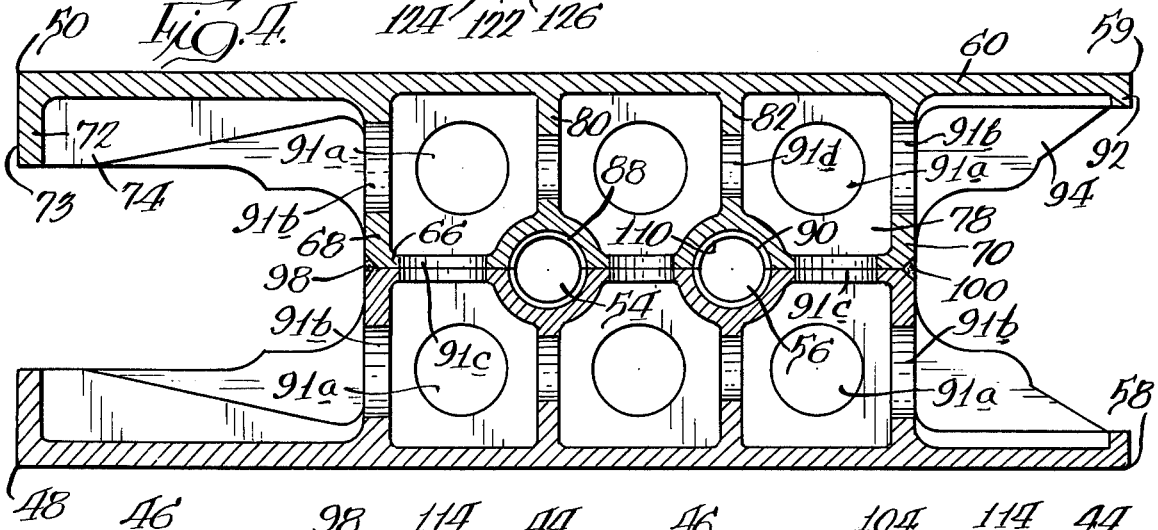
FIG. 4 is a greatly enlarged longitudinal sectional view taken substantially along line 4—4 of FIG. 1.
Figure 5:
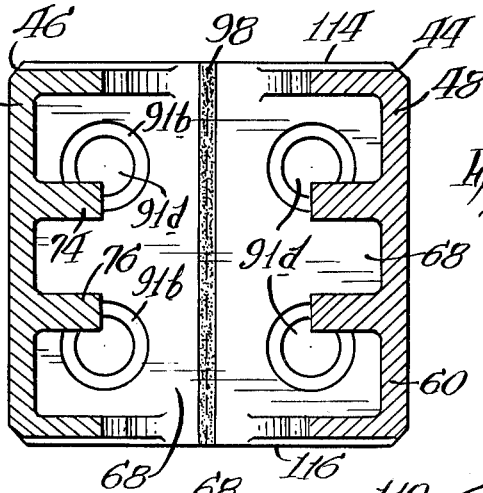
FIG. 5 is a greatly enlarged cross-sectional view taken substantially along line 5—5 of FIG. 1.
Figure 6:
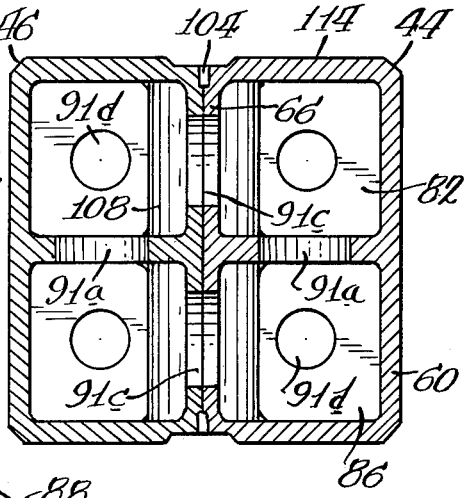
FIG. 6 is a greatly enlarged cross-sectional view taken substantially along line 6—6 of FIG. 1.
Figure 7:
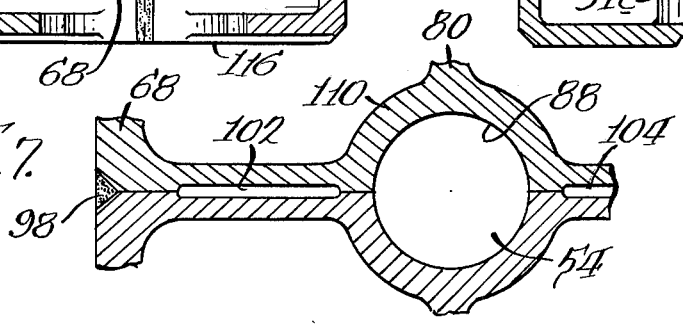
FIG. 7 is an enlarged cross-sectional view taken substantially along line 7—7 of FIG. 3.

Structurally each side member 44 is symmetrical about a longitudinal center line and includes a longitudinally extending outer side wall 60, a top web 62, a bottom web 64, and an inner face 66 as best shown in FIG. 4, that is shorter than the outer side wall. A pair of transverse walls 68 and 70, one at each end of the inner face 66, form the boxlike center portion 52*a* by joining inner face 66 to outer side wall 60 and the top and bottom webs 62 and 64.

The rear draft lug 50 is formed by the outboard end of the outer side wall 60, the top web 62, the bottom web 64, and a short outboard transverse return plate 72 which joins the webs 62 and 64 and the wall 60. This plate has a face 73 which defines one end of the brace and defines the face of the rear draft lug 50. A pair of longitudinally extending reinforcing ribs 74 and 76 extend along the inner surface of the outer side wall 60 and connect the transverse plate 72 with the transverse wall 68.

The center section forming portion 52*a* includes a centrally positioned horizontal plate or rib 78 extending from side-to-side and end-to-end of the section 52*a*. Four internal ribs 80, 82, 84 and 86 join the center portion of outer side wall 60, the inner face 66, the horizontal rib 78 and either the top or bottom webs and thereby defines six weight-reducing chambers that are cored during casting. The inner face has two longitudinally spaced, open-ended, semicircular kingpin hole forming recesses 88 and 90 formed at the junction of each of the internal ribs and inner face 66. These recesses extend from the top to the bottom webs. The inner face 66 also includes three shallow oblong vertical recesses 89*a*, 89*b*, and 89*c* between which the recesses 88 and 90 are positioned.

The internal ribs, transverse walls and inner face which form the chambers in the center sections are provided with apertures, such as 91*a*, 91*b*, 91*c* and 91*d* that are cored for manufacturing and weight reduction purposes.

Each inner extension, such as 59, at the inboard end of the brace is formed by the outer side wall 60, top web 62, bottom web 64 and a short inboard return transverse plate 92 that joins the webs and wall. A pair of longitudinally extending reinforcing ribs 94 and 96 which extend along the inner side of the outside wall connect the transverse web 70 and the transverse plate 92.

Figure 3:
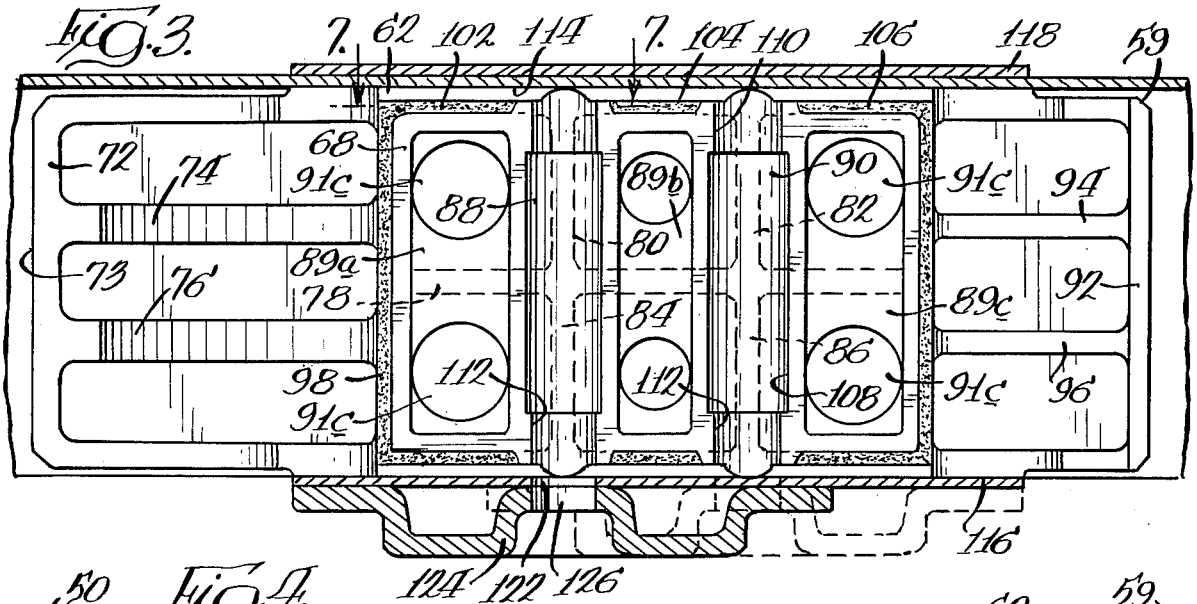
FIG. 3 is a greatly enlarged view of the installed center brace shown in FIG. 2, and showing in broken line a center plate positioned for use with the center brace in a box or gondola car.

The brace is fabricated by placing the inner faces of the side members 44 and 46 against each other and welding along vertical V-grooves 98 and 100 which are formed by chamfers on the vertical edges of the inner faces as best shown in FIG. 4. Recesses such as 102, 104 and 106 as best shown in FIG. 3, are located at the junction of the respective top webs along the top. A similar set of grooves is provided at the junction of the bottom webs.

When assembled the two side members 44 and 46 cooperate to define the two hollow kingpin holes 54 and 56 which are formed by the two sets of recesses 88 and 90 from respective side members. The recesses define a pair of elongated cylinders or king posts, each of which have an enlarged cylindrical center section, such as 108, terminating at each end in small diameter cylindrical sections, such as 110 and 112, which act as a journal for the kingpin inserted into the kingpin hole.

The top web 62 has a top wall surface 114 which is symmetrical with a bottom wall surface 116 formed by the bottom web 64. When the brace is installed, the side walls fit flush against the inner surfaces of the sill side walls 20 and 22, and the brace top wall surface 114 fits flush against the inside of the sill top surface. The brace top and bottom wall surfaces 114 and 116 are parallel to each other and functionally identical. Furthermore since the brace is symmetrical about a horizontal plane between the top and bottom walls, the brace can be installed in the sill with either the top or bottom wall surface 114 or 116 against the inside of the sill top web.

When installed, the face 73 of the rear draft lugs is spaced from the inner faces 34 and 36 of the striker assembly 28 by the standard distance and thus defines a draft gear pocket 117 of the standard size. When installed in the sill, the bottom wall surface 116 protrudes below the bottom edges of the sill and the protrusion is machined after installation so as to provide a smooth undersurface.

A body bolster having top and bottom plates 118 and 120 is mounted transversely across the sill at the center brace. The lower plate has an aperture 122 for alignment with kingpin hole 54. The center plate 124, which is mounted to the sill below the lower plate, also includes a single aperture 126 for alignment with the kingpin hole 54.

Figure 2:
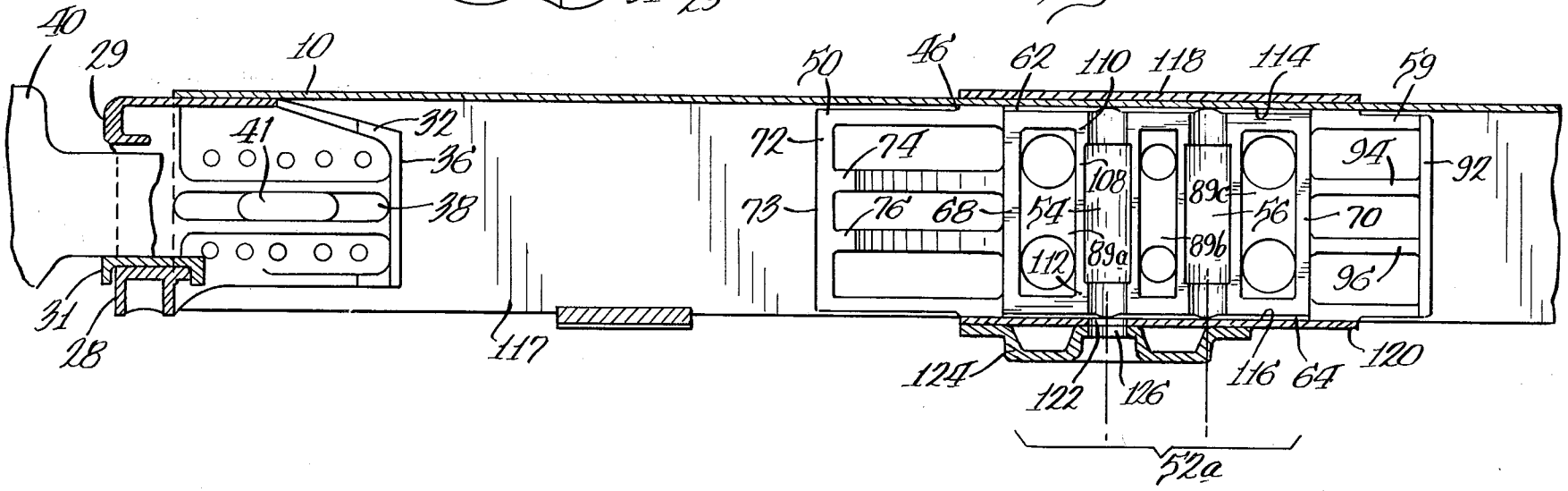
FIG. 2 is an enlarged cross-sectional view of an assembly of the type shown in FIG. 1 for use in a hopper car.

The assembly of FIGS. 2 and 3 is set for use in a hopper car. It will be appreciated that if the center plate is repositioned in the inboard direction, as shown by the broken lines in FIG. 3 so that the aperture 126 is in alignment with the kingpin hole 56 and the lower plate 120 is appropriately apertured, then the brace is set for use with a box or gondola car.

In the center brace as shown, the distance from the center line of the outboard kingpin hole 54 to the face 73 of the rear draft lugs is 17⅛ inches and the distance from the center line of the inboard kingpin hole 56 to the face 73 of the rear draft lugs is 23⅛ inches. Furthermore, in the center brace as shown, the distance from the center line of the outboard kingpin hole 54 to the striker face 29 is 4 feet 11½ inches and the distance from the center line of the inboard kingpin hole 56 to the striker face 29 is 5 feet 5½inches.

It will be appreciated that numerous changes and modifications can be made to the embodiment shown herein without departing from the spirit and scope of this invention.

What is claimed and desired to be secured by Letters Patent of the United States is:

1. An elongated center brace for use in a railway hopper, gondola or box car having an associated truck centerline spaced a respective distance dependent on the type of car from a striker assembly carried by a center sill associated with said car, the improvement comprising, in combination, rear draft lugs on said center brace spaced longitudinally along said center sill a standard distance from said striker assembly irrespective of the type of car, a first king pin hole in said center brace for receiving a truck king pin, said first king pin hole being spaced longitudinally of said rear draft lugs a first predetermined distance corresponding to one type of car, a second king pin hole in said center brace positioned longitudinally of said first king pin hole and in alignment therewith at a second predetermined distance from said rear draft lugs corresponding to another type of car for receiving a truck king pin spaced at said second distance from said rear draft lugs, said first king pin hole being adapted to receive a truck king pin associated with a hopper car and said second king pin hole being adapted to receive a truck king pin associated with a box or gondola car while said striker assembly is retained at said standard distance from said rear draft lugs, and said center brace being formed substantially symmetrical about a horizontal plane so that said center brace may be secured to said center sill with either side up and still permit use of either of said first and second king pin holes.

2. A center brace as defined in claim 1 where said brace is formed in two half sections each comprising a respective side portion of the center brace, said half sections being welded together to form an integral casting.

3. A center brace as defined in claim 2 where said two half sections are substantially identical.

* * * * *